United States Patent [19]

Arsenault

[11] Patent Number: 4,941,611

[45] Date of Patent: Jul. 17, 1990

[54] TOY ROADWAY TILE

[75] Inventor: Duane R. Arsenault, 86 Prospect St., Gardner, Mass. 01440

[73] Assignees: Alan J. Kirby, Tyngsboro; Duane R. Arsenault, Gardner, both of Mass.

[21] Appl. No.: 931,639

[22] Filed: Nov. 17, 1986

[51] Int. Cl.[5] ..... A63H 18/02

[52] U.S. Cl. ..... 238/10 A; 238/10 B; 446/121; 446/116

[58] Field of Search ..... 238/10 A, 10 B, 10 C, 238/10 E, 10 F; 446/108, 115, 116, 120, 121, 125, 444; 24/575, 576, 578, 662, 664; 403/339, 347, 364

[56] References Cited

U.S. PATENT DOCUMENTS

| | | | |
|---|---|---|---|
| 1,800,956 | 4/1931 | Peterson | 238/108 |
| 2,354,485 | 7/1944 | Slaughter | 446/108 X |
| 3,025,626 | 3/1962 | Schumacher | 238/10 B |
| 3,402,503 | 9/1968 | Glass | 446/91 |
| 3,413,752 | 12/1968 | Perry | 446/121 |
| 3,414,194 | 12/1968 | Seitzinger | 238/10 R |
| 3,579,904 | 5/1971 | Genin | 238/10 B |
| 3,623,261 | 7/1970 | Freese | 446/116 |
| 3,690,031 | 9/1972 | Shinoda | 446/96 |
| 4,346,889 | 8/1982 | Barlow | 273/1 |
| 4,504,243 | 3/1985 | Barlow | 446/447 |

FOREIGN PATENT DOCUMENTS

| | | | |
|---|---|---|---|
| 1156688 | 10/1963 | Fed. Rep. of Germany | 446/120 |
| 705653 | 3/1954 | United Kingdom | 446/120 |
| 914264 | 1/1963 | United Kingdom | 446/116 |

OTHER PUBLICATIONS

Tricky Track Instruction Sheet, Kusan Mfg. Co., Nashville, Tenn. 37212.

Trax (Excalibre Games).

Whittle Chips Delux Transport System, Sears Catalog, p. 551 (item 4).

*Primary Examiner*—James B. Marbert

*Assistant Examiner*—Frank H. Williams, Jr.

*Attorney, Agent, or Firm*—Blodgett & Blodgett

[57] ABSTRACT

Tile for use in forming a toy roadway, each tile having a roadway pattern formed on it and each tile having an engagement structure for interlocking with similar adjacent tiles to form a complete system. The pattern of the roadways of the complete system may be varied by simply changing the orientation of one side of the toy roadway tile or by changing the alignment of an edge of one or more tiles.

4 Claims, 16 Drawing Sheets

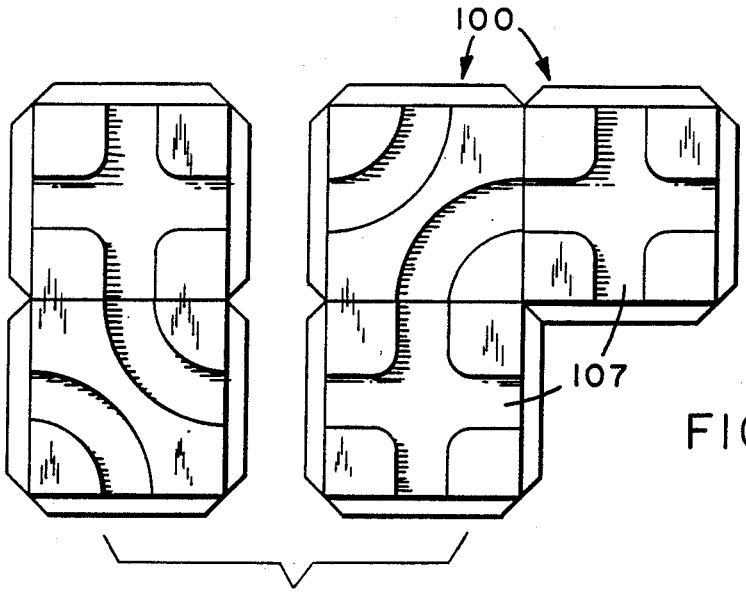
FIG. 6
FIG. 7
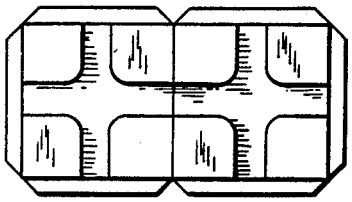
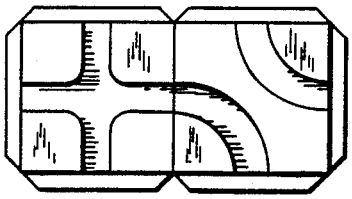
FIG.8
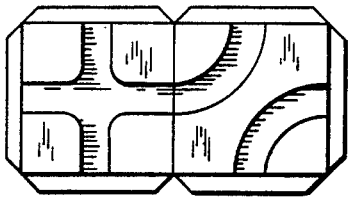
FIG.9
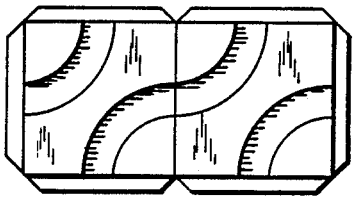
FIG.10
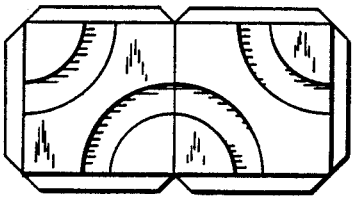
FIG.11
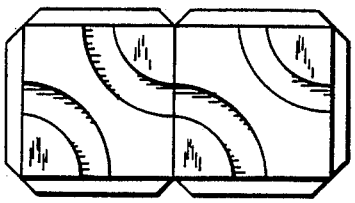
FIG.12

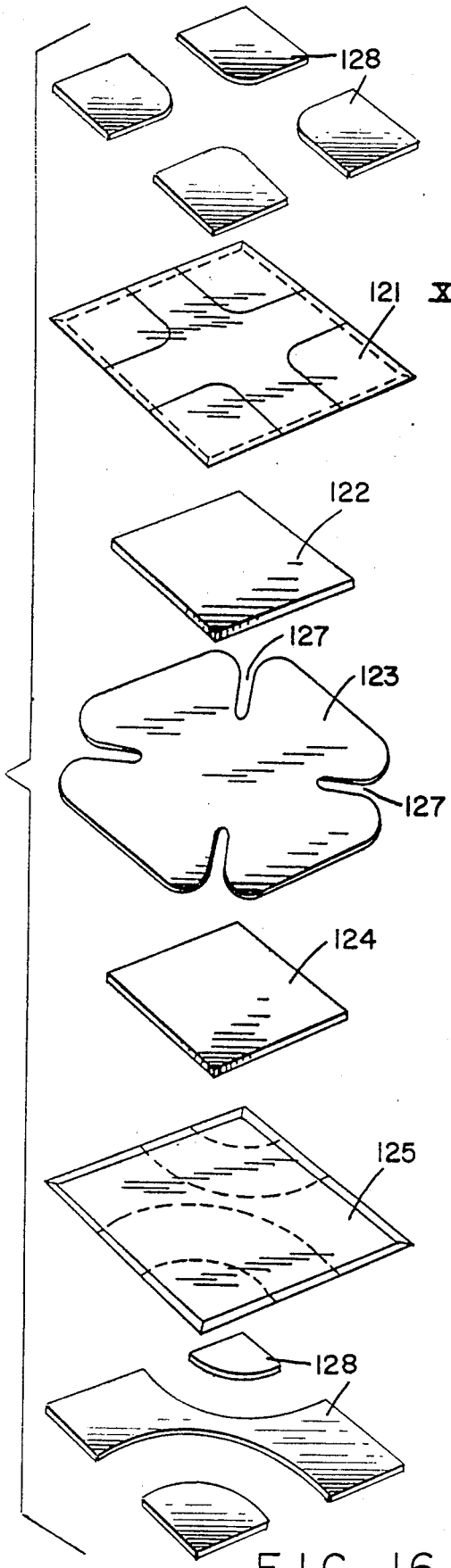
FIG. 16
FIG. 17
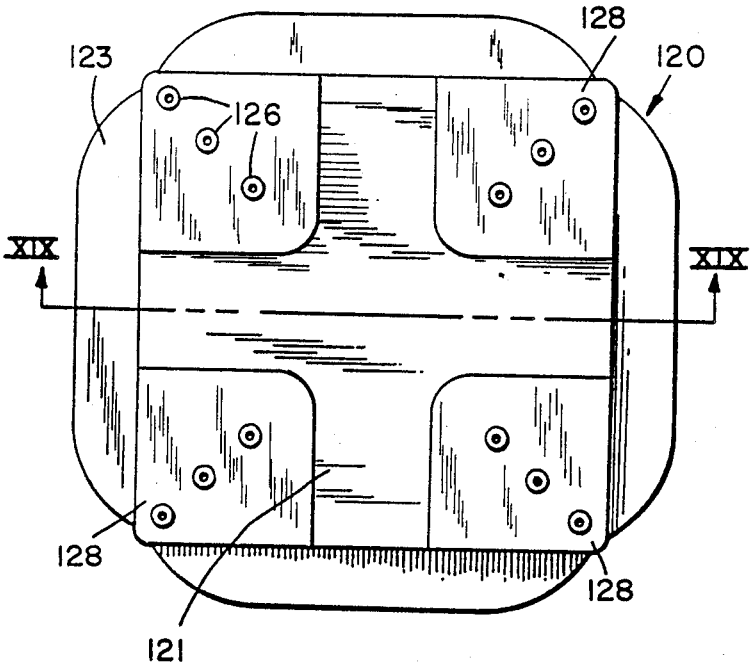
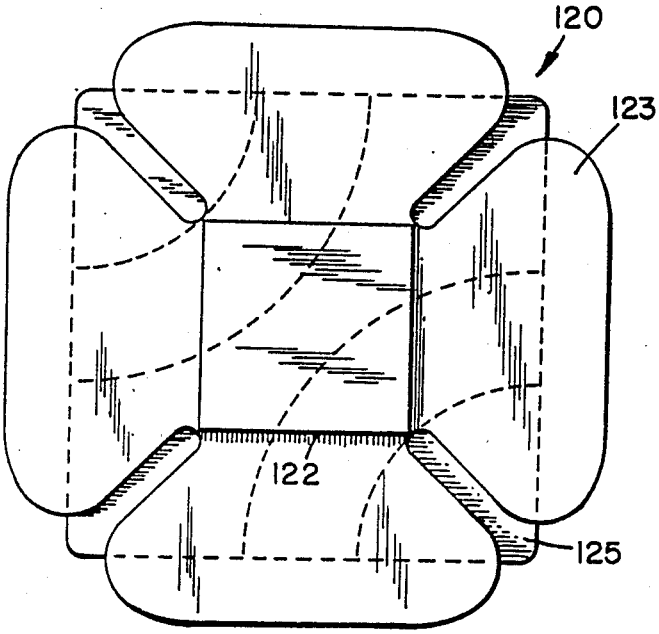
FIG. 18
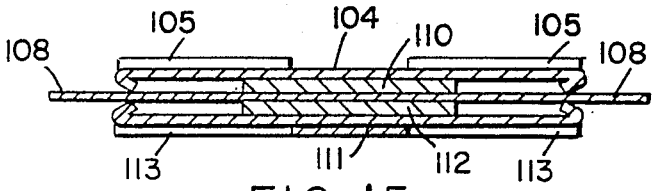
FIG. 15

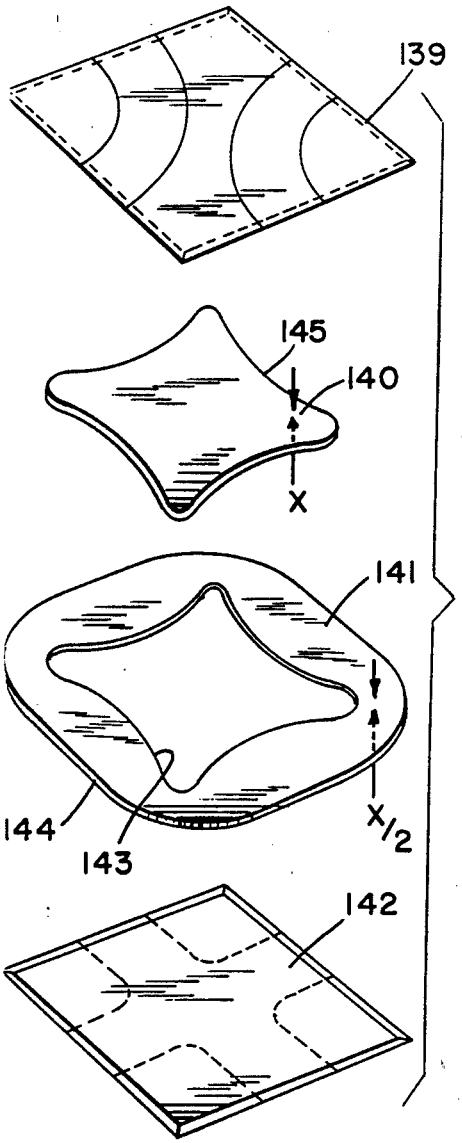
FIG. 23
FIG. 24
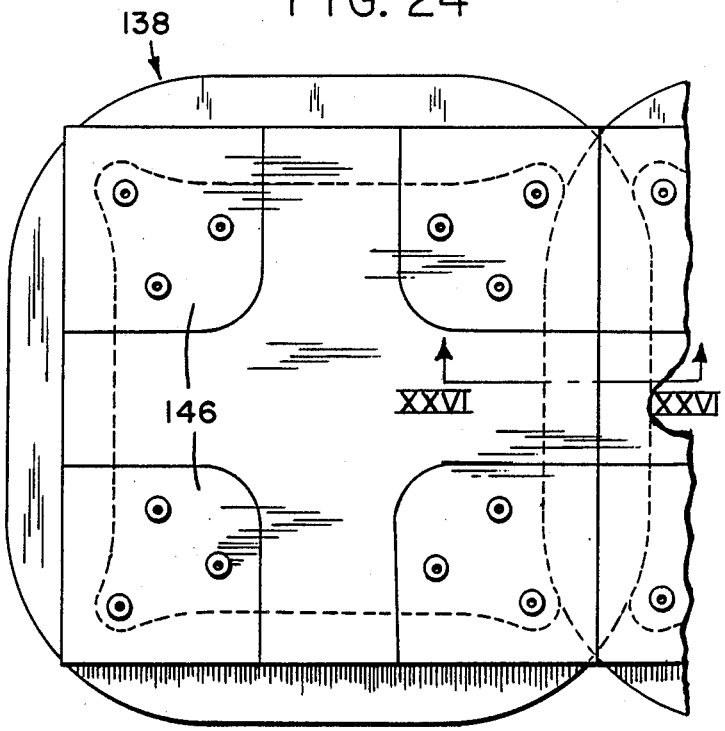
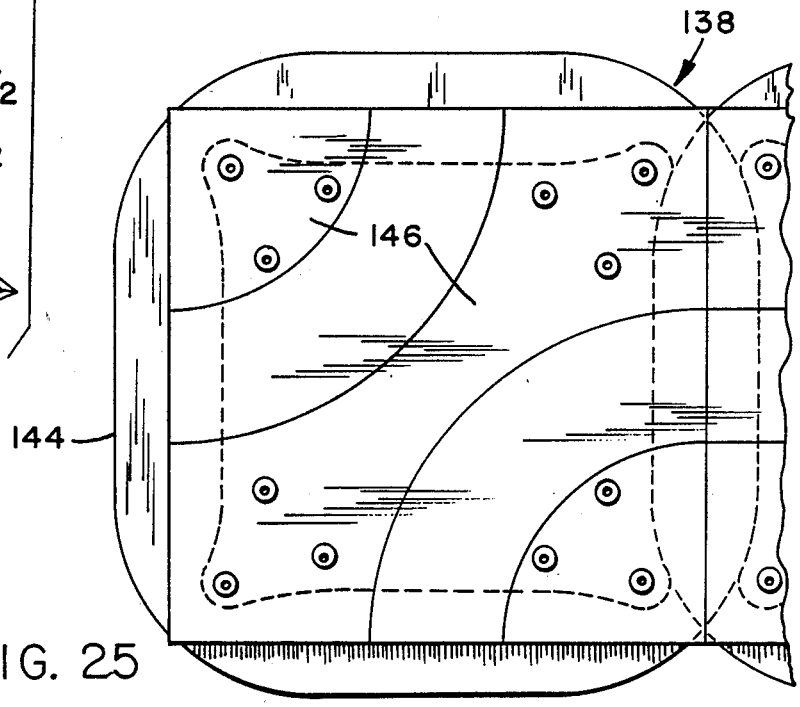
FIG. 25
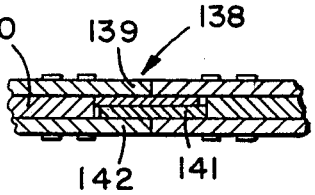
FIG. 26

TOY ROADWAY TILE

BACKGROUND OF THE INVENTION

One of the most enjoyable pastimes for children is the use of toy automobiles which are caused to progress along a pattern of roadways. It is common practice to print such roadways on a large board, but such a board is ungainly, difficult to store, and has an invariable pattern. Attempts have been made to print parts of the roadway on separate pieces of board but, when this is done, assembling a complete set of roadways is less than desirable, because the separate boards become separated and gives an unsmooth path. Furthermore, there is difficulty in bringing about variations in the pattern of the roadway; a single layout of roadways becomes rather dull for the child, particularly when there is no way of varying the roadway to make it more interesting. Furthermore, the devices that are presently available have elements that are easily broken, which are difficult for a child to assemble and disassemble, and may contain dangerous sharp protuberances or corners. Some systems contain separate pieces for joining the parts of the board together and these pieces are easily lost. These and other difficulties experienced with the prior art devices have been obviated in a novel manner by the present invention.

It is, therefore, an outstanding object of the invention to provide a toy roadway tile which permits the formation of a large variety of patterns of roadway.

Another object of this invention is the provision of a tile for the formation of a roadway pattern, which tile is capable of being easily attached to other tiles to form a complex pattern.

A further object of the present invention is the provision of a tile for use in forming a toy roadway, wherein connecting elements are provided which are integral with the tile.

It is another object of the instant invention to provide a toy roadway tile which is simple in construction, which is inexpensive to manufacture, and which is capable of a long life of useful service.

A still further object of the invention is the provision of a tile for use in forming a toy roadway in which a number of tiles having exactly the same construction and roadway pattern can be used in various ways to complete a complex roadway pattern.

It is a further object of the invention to provide a toy roadway system consisting of a number of tiles all of which are exactly the same in the nature of their connecting means and in the pattern of their roadways.

It is a still further object of the present invention to provide a tile having an integral means for interconnecting it with tiles of a similar nature.

Another object of the invention is the provision of a road building toy requiring only the undeveloped physical motor skills of young children.

Another object of the invention is the provision of a toy for forming a complex roadway configuration, including a tile having connecting means that is integrally formed, so that it cannot become lost.

With these and other objects in view, as will be apparent to those skilled in the art, the invention resides in the combination of parts set forth in the specification and covered by the claims appended hereto.

SUMMARY OF THE INVENTION

In general, the invention consists of a toy roadway tile having a main body formed of sheet material and having at least three straight side edges of equal length. The surface of the main body is provided with visual land areas defining a roadway configuration within the main body consisting of a pattern in which a roadway terminates at the center of one side edge of the main body. A tab plate is provided that extends beyond the periphery of the main body, which plate can be placed and clamped between the main body and tab plate of another similar tile formed with a roadway that terminates on a side that is aligned with a similar roadway on the first-recited tile.

More specifically, the pattern of roadways on one main body is a cross, each of whose arms terminate at the center of one of four sides, while the pattern of roadways of a second main body on the other side of the tile consists of arcuate roadways whose ends terminate at the centers of the four sides.

More specifically, a second main body is provided which is similar in size to the said main body and is attached to the other surface of the tab plate. A spacer is sandwiched between each main body and its respective surface of the tab plate.

BRIEF DESCRIPTION OF THE DRAWINGS

The character of the invention, however, may be best understood by reference to several of its structural forms, as illustrated by the accompanying drawings, in which:

FIG. 6 shows a typical roadway system and the manner in which the separate tiles are assembled, FIGS. 7–12 show various roadway configurations that can be obtained by matching two toy roadway tiles together, FIG. 16 is an exploded view of a still further modified form of the tile, showing the parts before assembly, FIG. 17 is a top plan view of the tile shown in FIG. 16 in assembled form, FIG. 18 is a sectional view of the tile of FIG. 17 with portions removed, FIG. 23 shows an exploded view before assembly of a still further form of the invention, FIGS. 24 and 25 are top plan and bottom plan views, respectively, of the tile shown in FIG. 23, FIG. 26 is a vertical sectional view of the tile taken on the line XXVI—XXVI of FIG. 24, FIGS. 27 and 28 show top plan and bottom plan views, respectively, of another form of the invention.

DESCRIPTION OF THE PREFERRED EMBODIMENT

Figure 1:
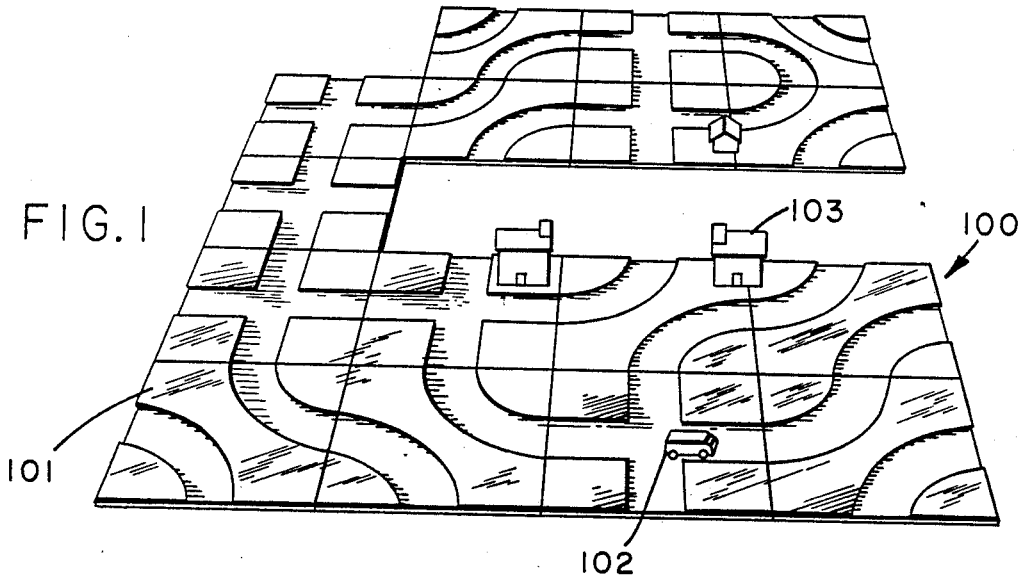
FIG. 1 shows a toy roadway tile embodying the principles of the present invention, shown in use in a toy roadway system.

Referring first to FIG. 1, which best shows the general features of the invention, it can be seen that the toy roadway tile, indicated generally by the reference numeral 100, is shown in use with similar tiles in a toy roadway system 101. The system is shown as having a roadway of complex form on which are carried toy automobiles 102. Various suitable buildings 103 may be provided throughout the system.

Figure 2:
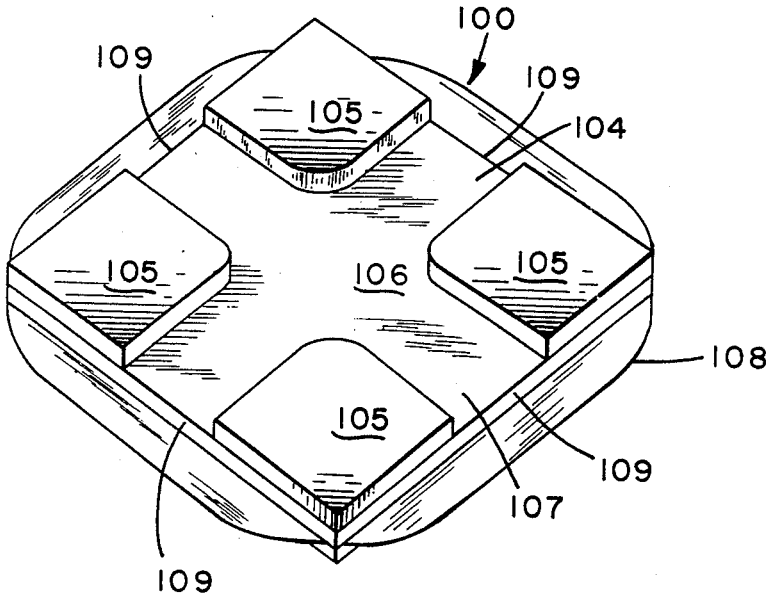
FIG. 2 is a perspective view of the tile.

Referring next to FIG. 2, it can be seen that the tile 100 is provided with a main body 104 which is formed of sheet material and has a plurality of edges 109. The main body is provided with visual land areas 105 which are associated with the top surface 106 and which serve to define a roadway 107 lying within the periphery of the main body. A tab plate 108 is attached to the bottom surface of the main body 104 and extends beyond the edges 109 thereof, so that the plate can be placed between the main body and the corresponding tab plate of another similar tile.

Figure 3:
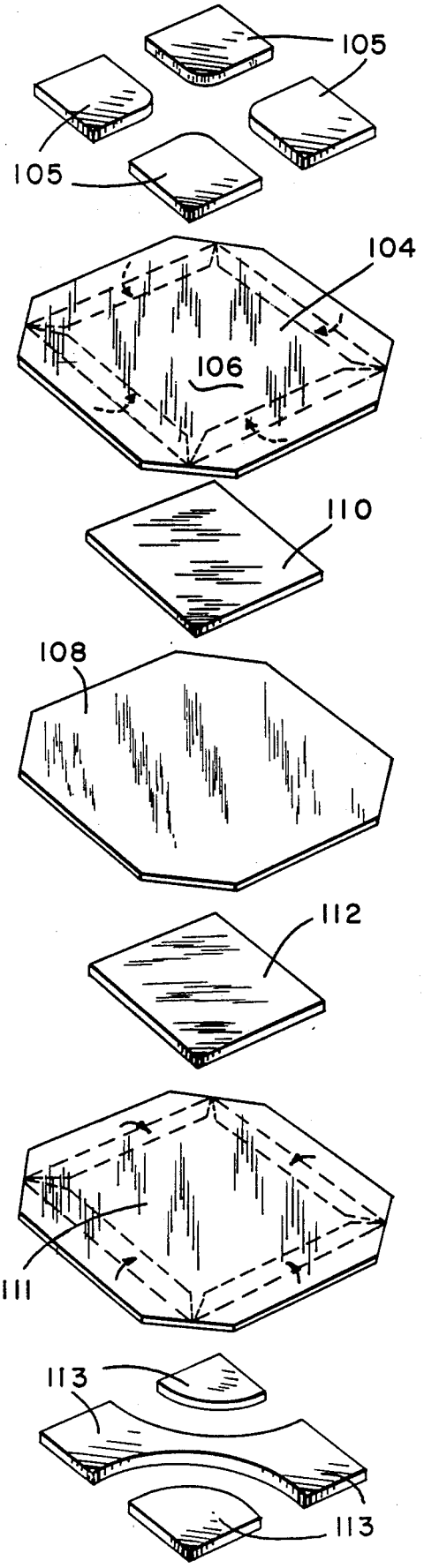
FIG. 3 is an exploded view of the parts of the tile before assembly.

FIG. 3 shows the details of construction of one form of the tile 100 and it shows the manner in which the parts are assembled. It is clear that a spacer 110 lies between the main body 104 and the bottom surface of the tab plate 108. The main body is connected to the tab plate inwardly of its edges 109, so that the tab plate of a similar tile can be clamped between the main body and the tab plate.

The tile is provided with a second main body 111 which is similar in size to the said first main body 104 and is attached to the other surface of the tab plate through a spacer 112. The top surface of the main body 111 is provided with land areas 113 defining a different pattern of roadway as, will be explained further hereinafter.

Figure 4:
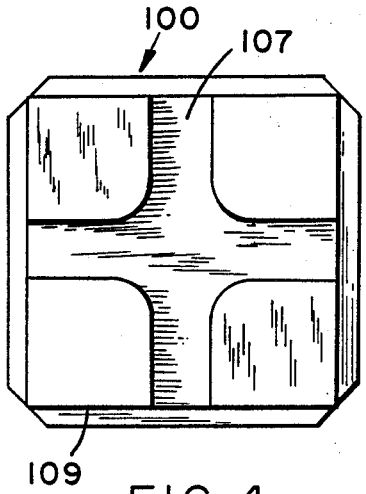
FIGS. 4A and 4B show roadway patterns on the two sides of the tile.
Figure 5:
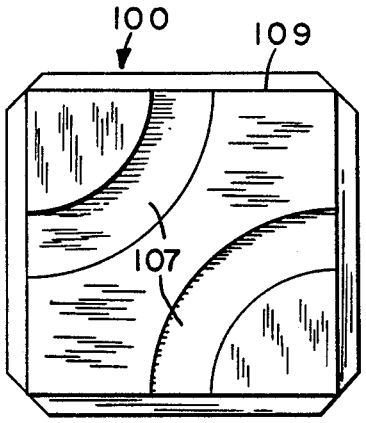
FIG. 5 shows a vertical sectional view of the tile taken along line V—V of FIG. 4A.

In FIG. 3 each main body 104 and 111 is formed of sheet material and each edge of each main body is folded under to provide a resilient clamped lip 129 (See FIG. 5) between the main body and the tab plate 108. FIGS. 4A and 4B shows top and bottom plan views of the tiles 100, showing a roadway 107 in the shape of a cross, whose arms terminate at the center of the sides 109 of the tile. As is evident in FIG. 6, similar tiles 100 and 100 are joined together so that the roadways 107 form a continuous pattern. FIGS. 7, 8, 9, 10, 11, and 12 show ways in which the tiles can be turned to provide different overall patterns of roadways.

Figure 13:
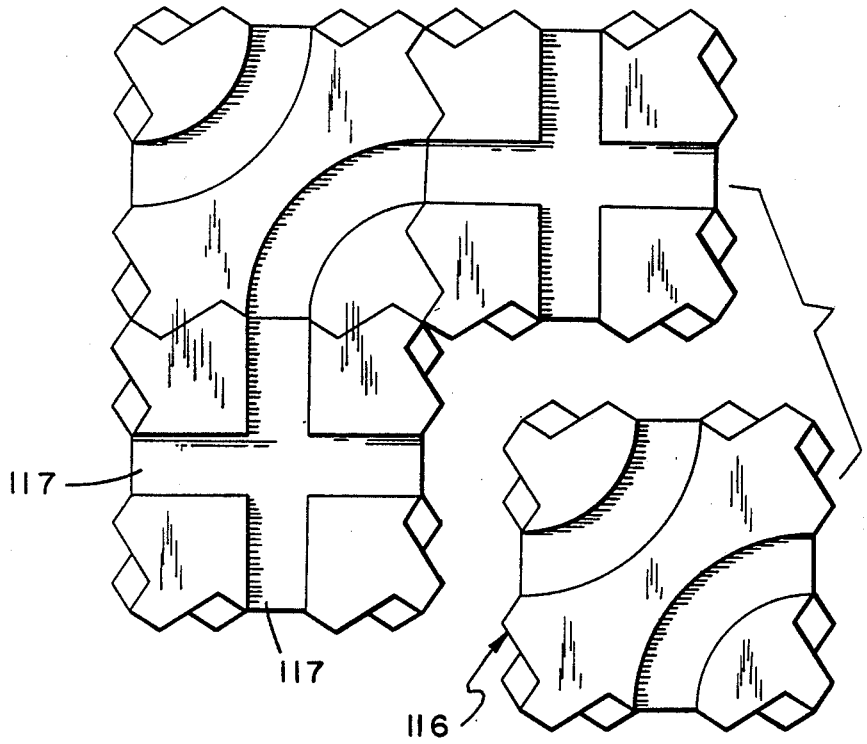
FIG. 13 shows a variation of the toy roadway tile, as used to develop a roadway system.

FIG. 13 shows the manner in which a modified form of the invention in the form of a tile 116 is joined with other similar tiles to form a continuous roadway.

Figure 14:
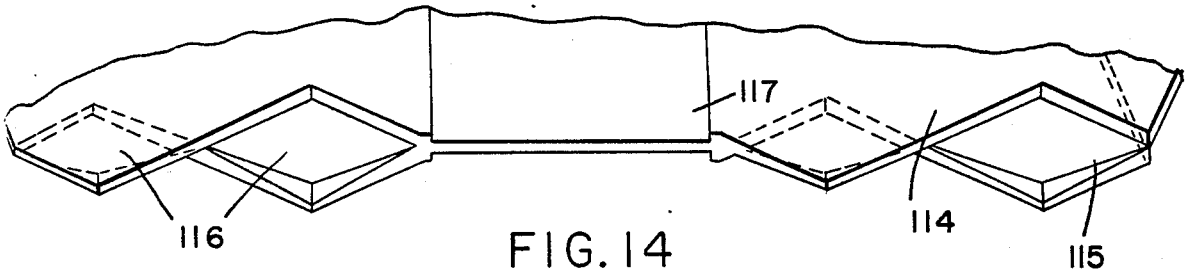
FIG. 14 shows an end view of the tile shown in FIG. 13 in perspective.
Figure 15:
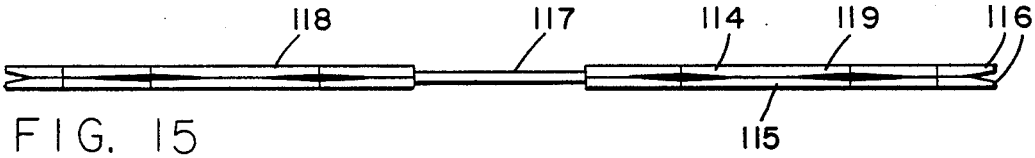
FIG. 15 is a front elevational view of the tile shown in FIG. 13.

FIG. 14 is a perspective view of the end of the tile 116, showing the manner in which the two main bodies are joined together Main bodies 114 and 115 are joined together by means of integral triangular tabs 116 that are adapted to interlock with the main bodies and tabs of similar tiles The appearance of the tile in its front elevation is shown in FIG. 15; the two main bodies 114 and 115 are joined together and are provided with a roadway 117 lying between land areas 118 and 119.

FIGS. 16, 17, 18 and 19 show a modified form of the tile As is evident in FIG. 16, the tile 120 is provided with a main body 121 with raised land areas 128, a spacer 122, a tab plate 123, another spacer 124 and a second main body 125. As is evident in FIG. 17, these elements are held together by rivets 126. FIG. 18 shows the tile 120 with the first main body 121 removed thus exposing the spacer 122, the tab plate 123, and the second main body 125. As is evident in this view, the tab plate 123 is generally square in shape and is provided with a notch 127 at each corner, which notch serves to divide the outer edges of the tab plate into four tabs 128. Each tab has curved corners that engage stops provided by the edges of a spacer 124 and 122.

Figure 19:
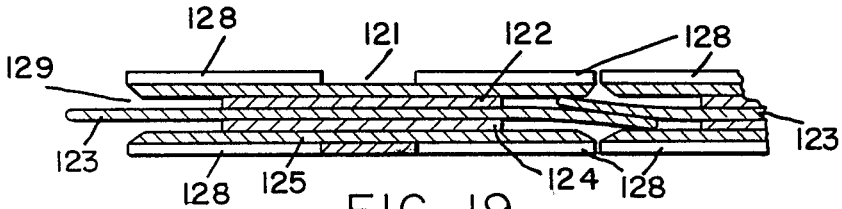
FIG. 19 shows a vertical sectional view of the tile taken on the line XIX—XIX of FIG. 17, FIGS. 20 and 21 show, respectively, top plan and bottom plan views of another form of the invention.

FIG. 19 shows particularly well the manner in which raised land areas 128 are provided on the main bodies 121 and 125 to define the roadways It also shows the manner in which the tabs flex to form a resilient spring-like clamping means between the two main bodies.

Figure 20:
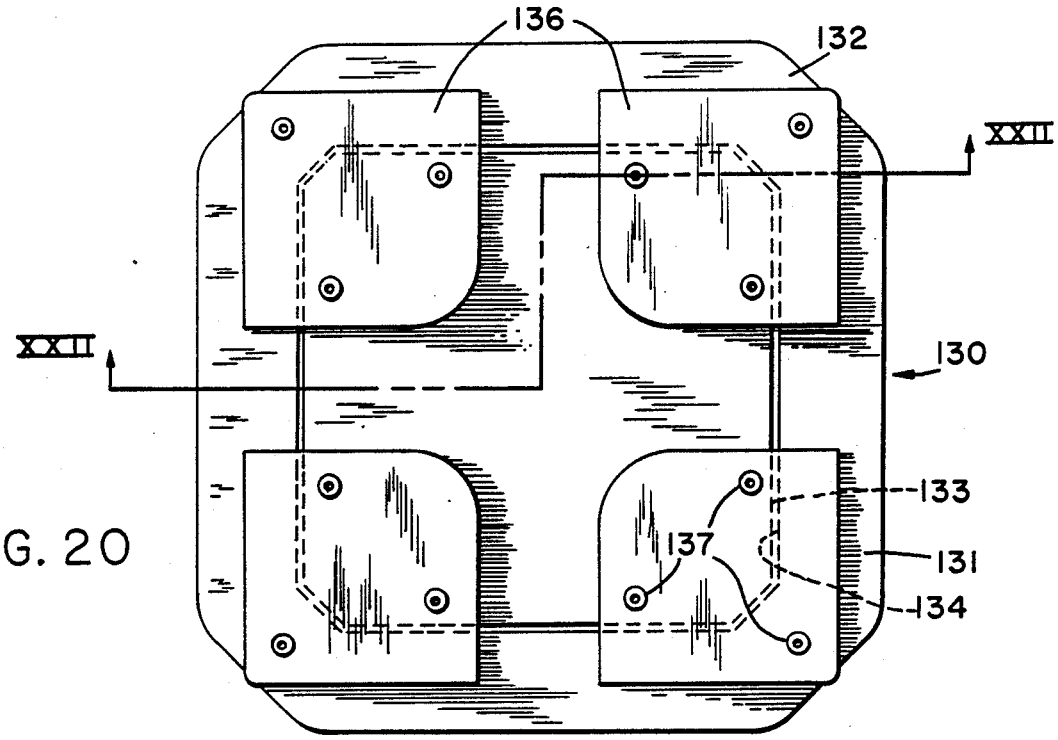
Figure 21:
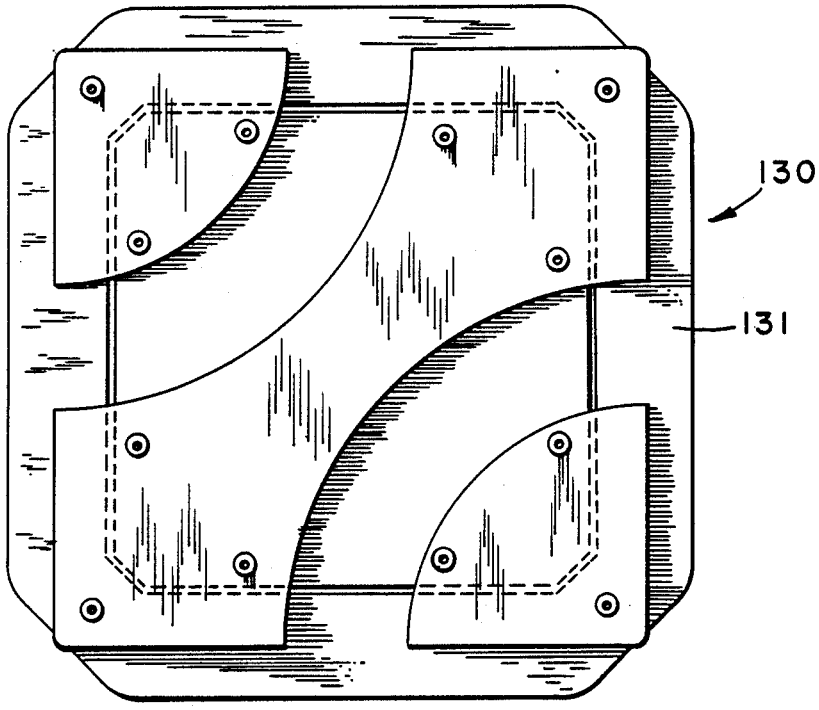
Figure 22:
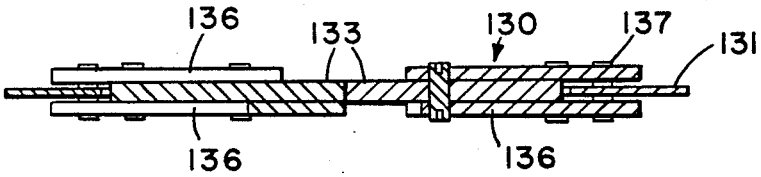
FIG. 22 is a vertical sectional view of the tile taken on the line XXII—XXII of FIG. 20.

FIGS. 20, 21, and 22 shows the details of construction of another modified form of the invention, including a tile 130 in which it can be seen that the tab plate 131 is generally square with a bevel 130 at each corner. A spacer 133 is also shown as generally square and resides in a similarly shaped aperture 134 formed in the tab plate 131. The main body 135 consists solely of land areas 136 formed of thick sheet material fastened by rivets 137 to the spacer 133 on the one hand and to the tab plate 131 on the other hand. As is evident in FIG. 22, the tab plate 131 is formed of sheet material of a first thickness and the spacer 133 is formed of sheet material of the thickness that is substantially greater than that of the tab plate.

FIGS. 23, 24, 25 and 26 show the details of another modified form of the invention. The tile 138 is shown in FIG. 23 as consisting of a first main body 139 which is joined through a spacer 140 to a second main body 142. Also lying between the two main bodies is a tab plate 141 having a central aperture 143 which is substantially the same size and shape as the spacer 140 except that the spacer has twice the thickness of the tab plate 141, as is evident in FIG. 26. It should be noted that each side edge 144 is curved to fit a similarly-shaped curve 145 on the spacer 140, thus acting as a stop and a locator to bring the land areas 146 into registry.

Figure 27:
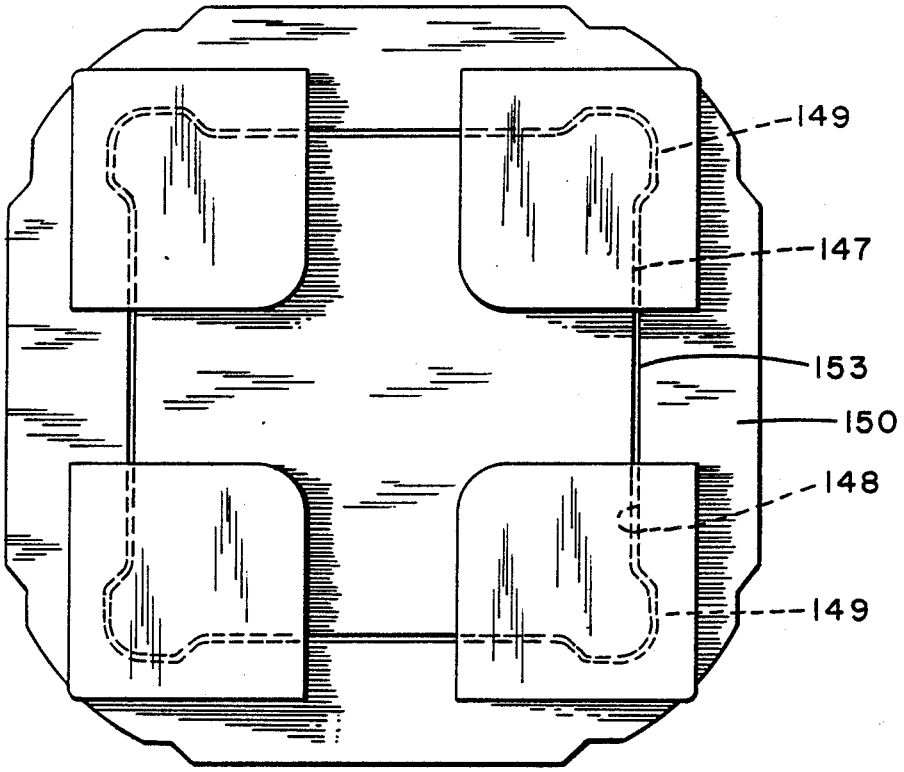
Figure 28:
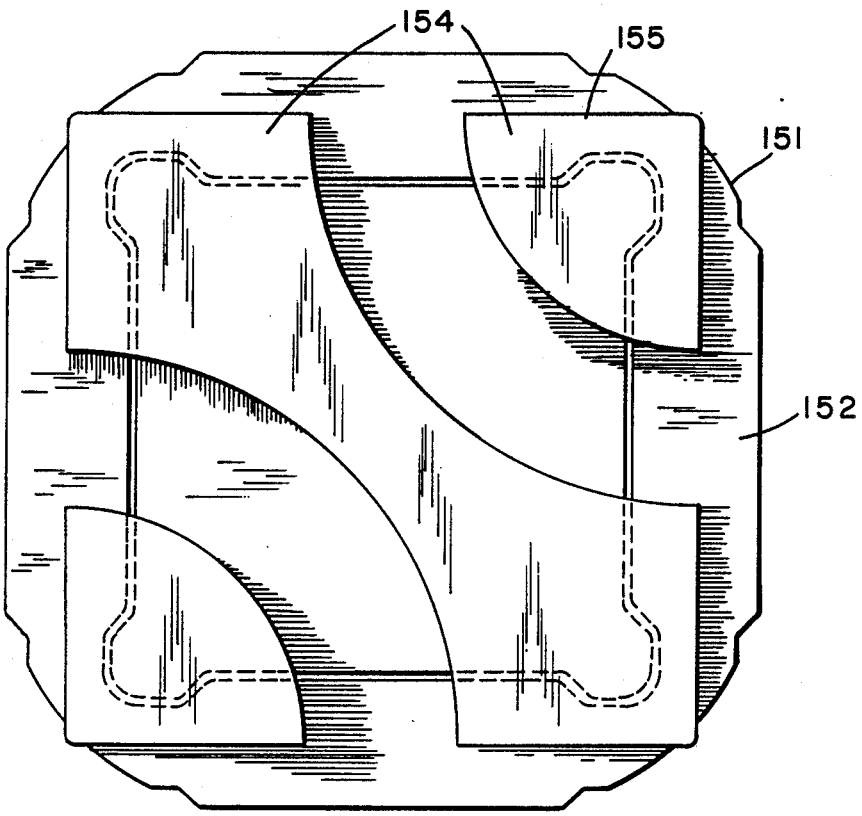

FIGS. 27 and 28 show a variation of the tile in which the spacer 147 and the aperture 148 are provided with an enlargement 149 at each corner. In this variation of the invention, the tab plate 150 is provided with an edge recess 151 that defines a tab 152 which is shaped to fit a recess 153 between the enlargement 149 at the two adjacent corners of the spacer 147 thus bringing the adjacent edges of the main bodies of mating tiles together.

In this version of the invention, the main body 155 is defined by the land areas 154 which are generally square in configuration. The tab plate 150 also has a square form and is larger than the main body. The spacer 147 is also generally square and is sandwiched between the main body (as defined by the land areas 154) and the tab plate 150. It lies, of course, in the similarly-shaped aperture 148 in the tab plate Each edge of the tab plate is provided with a male shape adapted to fit snugly into a female shape or recess 153 formed on a corresponding edge of the spacer, so that the roadways on the two tiles will form a continuous roadway.

Figure 29:
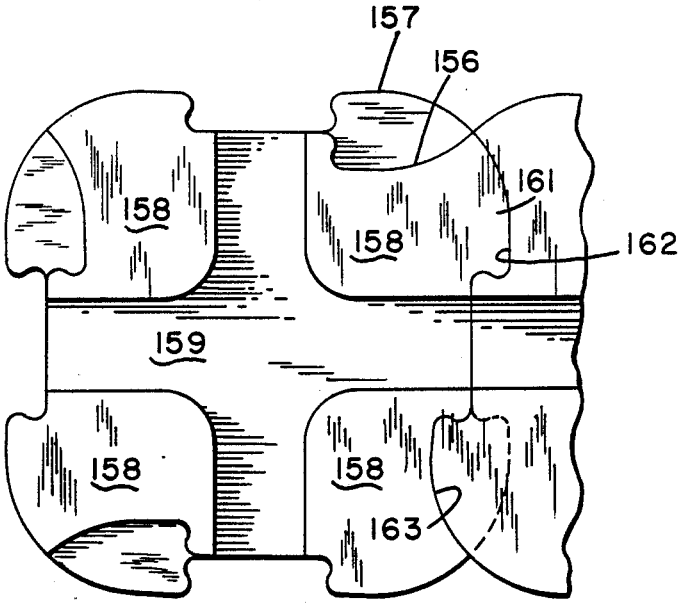
FIGS. 29 and 30 show top plan and bottom plan, respectively, of use of another modification of the invention.
Figure 30:
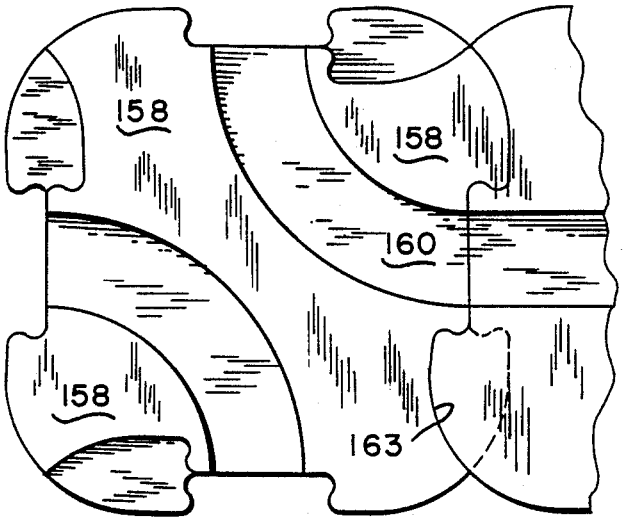

FIGS. 29 and 30 show a modified form of the invention made up of a first main body 156 formed of sheet material, having a plurality of edges defining a plurality of corners. A second main body is fastened to the first main body and has the same general shape Visual land areas 158 are associated with the non-facing surfaces of the main bodies, the land areas defining a roadway 159 within the confines of the main bodies 156 and 157. Means is provided to join the main bodies of the tile to the main bodies of a similar tile, thus bringing the edges into registry to form a continuous roadway between the tiles. Each edge of the first main bodies is provided with a male shape 161 adapted to fit snugly in a female shape 162 formed on a corresponding edge of a main body of the similar tile. The said male shape 161 consists of a curved protuberance adjacent one corner of the first main body and a similar oppositely curved recess adjacent the other corner of a side, the recess and protuberance defining a straight edge between them.

Figure 31:
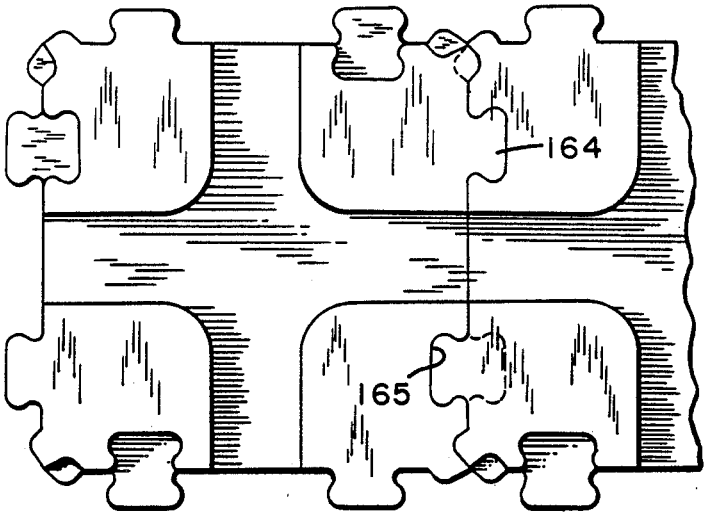
FIGS. 31 and 32 show top plan and bottom plan views, respectively, of a still further modified form of the invention.
Figure 32:
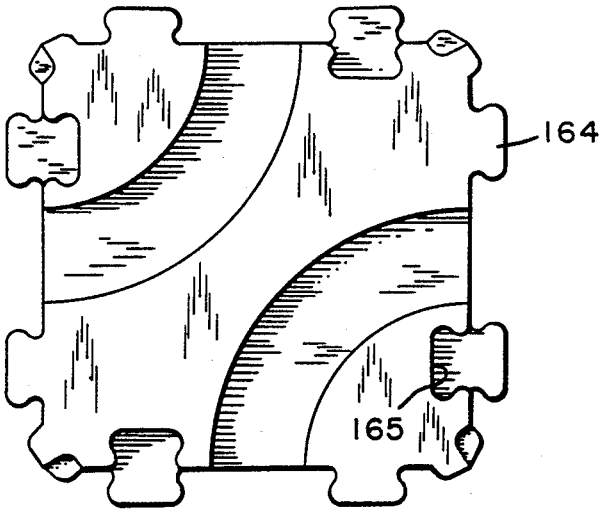

FIGS. 31 and 32 show a still further form of the invention in which the male shape 164 is trapezoidal in shape with rounded corners and the second main body prepares its female shape congruent with the male shape of the first main body and has its male shape congruent to the female shape of the first main body. When two tiles of this type are assembled to give the appearance shown in FIG. 31, the male shapes and the female shapes are alternated to lock the two tiles together and bring the straight edges of the bodies together to give a continuous roadway.

Figure 33:
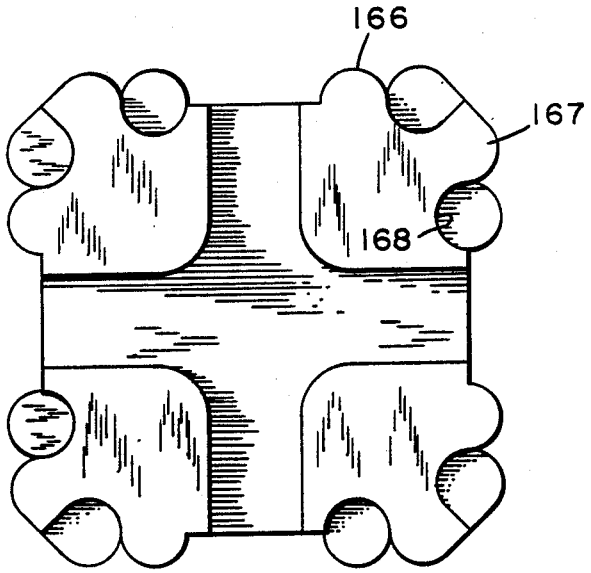
FIGS. 33 and 34 show top plan and bottom plan views, respectively, of a tile representing another form of the invention.
Figure 34:
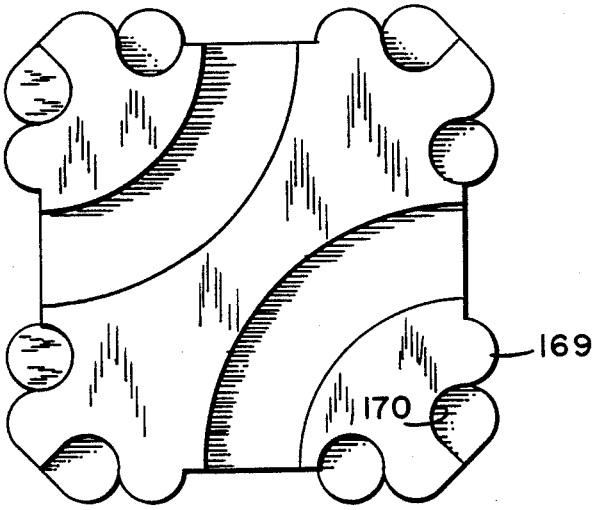

FIGS. 33 and 34 show a variation of the invention in which the male and female shapes are generally semicircular and each edge of each main body has two male shapes with a female shape adjacent it. For instance, the first main body of the tile 166 in FIG. 33 has a semi-circular male shape 167 with a semi-circular recess 168 next to it. The other end of that side of the main body is provided with another male shape 169 and a recess 170 beside it. Therefore, each male or female shape of the first main body is positioned with a shape of the opposite gender formed on the second main body so that, when a similar tile is brought into edge-to-edge relationship with the tile, the shapes take on an alternating over-and-under locking relationship.

Figure 35:
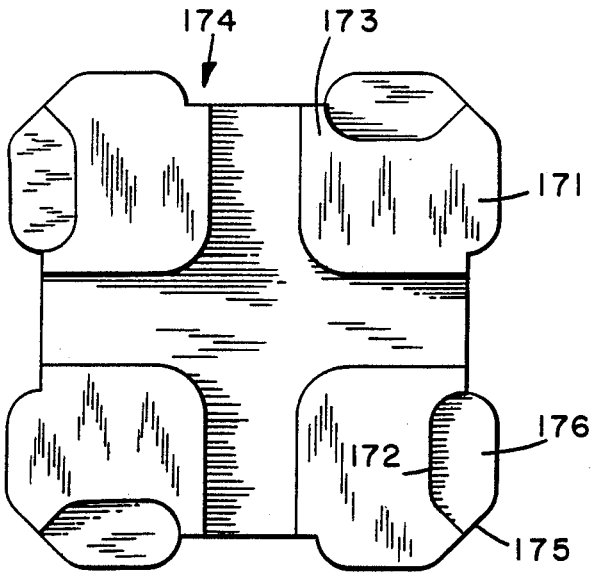
FIGS. 35 and 36 show top plan and bottom plan views, respectively, of a modified form of the tile.
Figure 36:
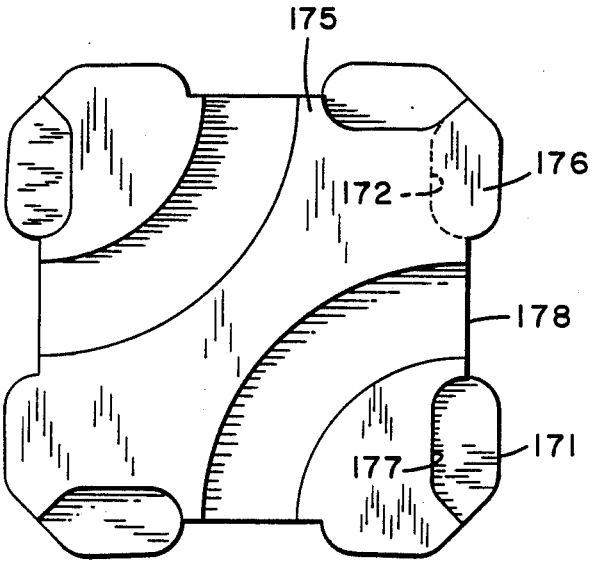

The variation of the invention shown in FIGS. 35 and 36 has a protuberance 171 and a recess 172 formed on the upper main body 173 of the tile 174. The second main body 175 is provided with a protuberance 176 underlying the recess 172, while a recess 177 underlies the protuberance 171 on the first main body. Arranging these protuberances and recesses results in the edge 178 of the two main bodies engaging and registering to line up the roadways in the desired manner.

Figure 37:
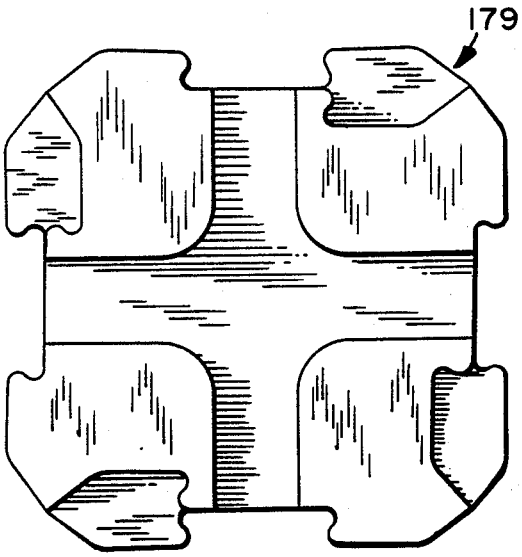
FIGS. 37 and 38 show top plan and bottom plan views, respectively, a still further modified form of the tile.
Figure 38:
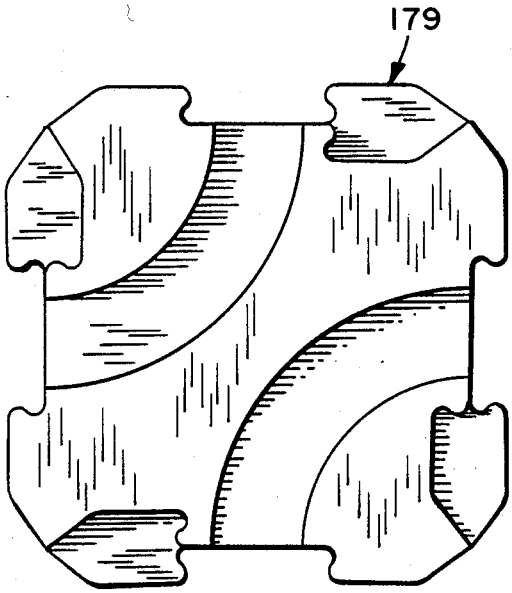

FIGS. 37 and 38 show a still further variation of the invention in which the tile 179 is provided with alternate protuberances and recesses which serve to register the edges of the main bodies, so that they line up and make continuous the roadways on similar tiles brought into engagement with it.

Figure 39:
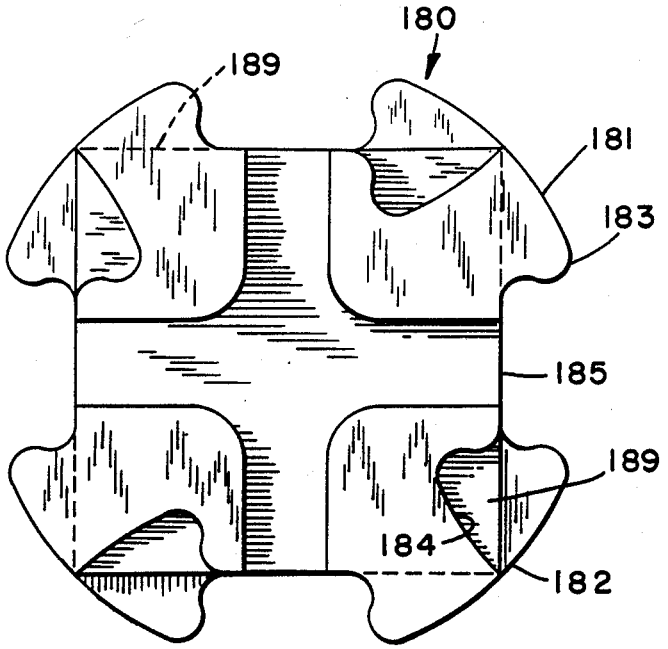
FIGS. 39 and 40 show top plan and bottom plan views, respectively, of another form of the tile.
Figure 40:
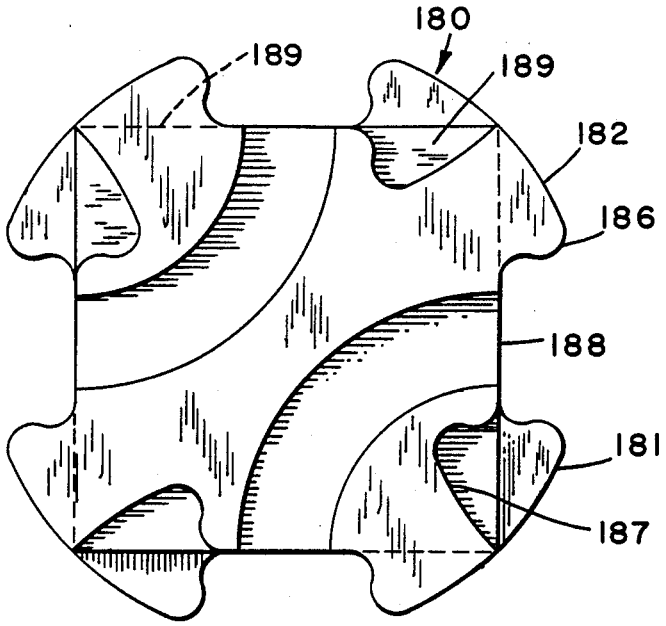

In FIGS. 39 and 40 the tile 180 is similarly a variation of the invention and includes a first main body 181 and a second main body 182 joined together. The main body 181 includes a protuberance 183 and a recess 184 formed along the edge 185. Similarly, the second main body 182 is provided with a protuberance 186 and a recess 187 formed along the edge 188. Extending between the main body 181 and the main body 182 is a square spacer 189 main bodies 181 and 182 consist solely of land areas whose individual sections are attached to the spacer 189. Spacer 189 functions as the roadway.

Figure 41:
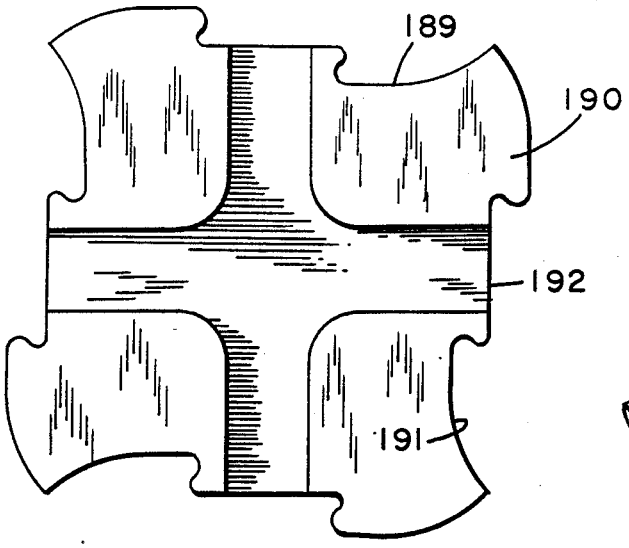
FIGS. 41 and 42 show top plan and bottom plan views, respectively, of a still further form of the tile.
Figure 42:
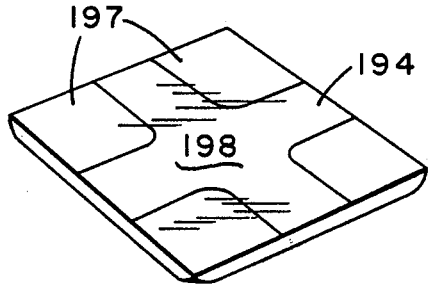
Figure 42:
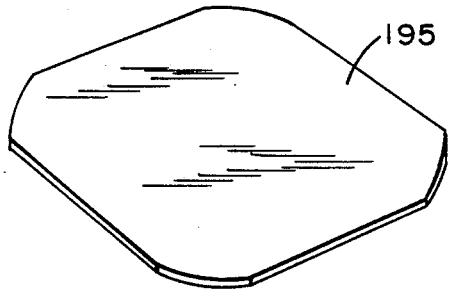
Figure 42:
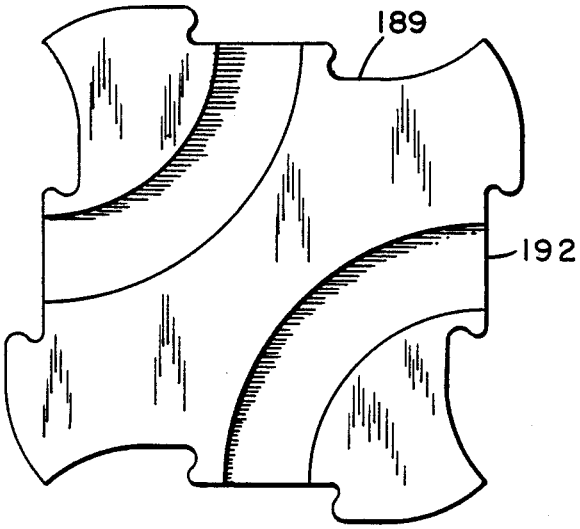

Referring to FIGS. 41 and 42, it can be seen that the tile 189 has a protuberance 190 along an edge 192, as well as a recess 191. The protuberances and recesses engage to locate and lock the edges 192 together to provide continuous roadway structure to an adjacent similar tile.

Figure 43:
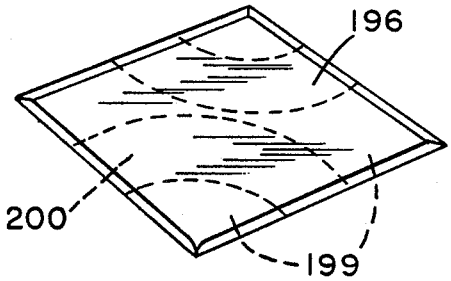
FIG. 43 shows an exploded view of another form of the tile before assembly.
Figure 44:
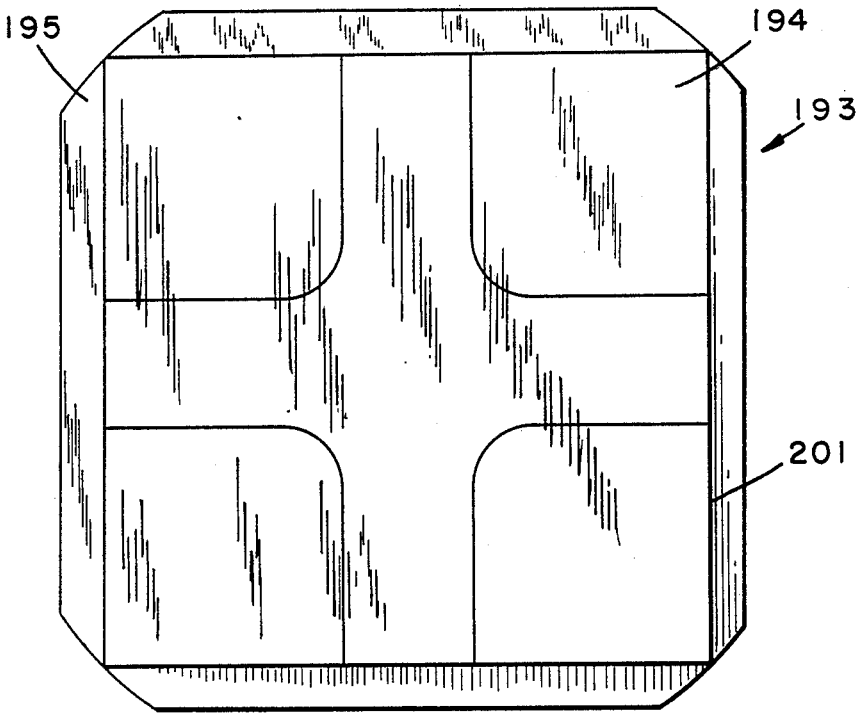
FIG. 44 is a top plan view of the tile shown in 43.
Figure 45:
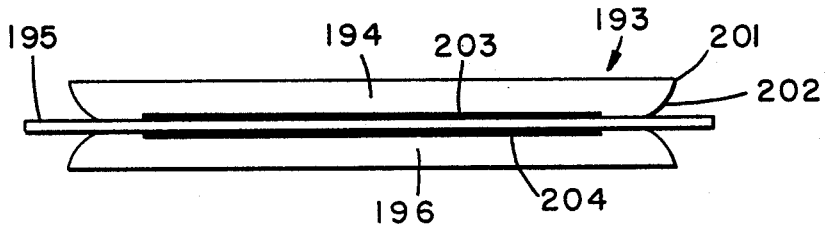
FIG. 45 is a front elevational view of the tile shown in 44.

FIGS. 43, 44 and 45 show a further variation of the invention including a tile 193 having a first main body 194 and a second main body 196 joined to a tab plate 195. The upper surface of the first main body is provided with land areas 197, lining a roadway 198. Normally, the second main body 196 is provided in its lower surface with land areas 199 defining a roadway 200. As is best evident in FIG. 45, all of the edges 201 are provided with an inward bevel 202, thus facilitating the slippage and entry of a tab plate of a similar tile between the main bodies 194 and 196 and the adjacent surfaces of the tab plate 195. As is evident in FIG. 45, the main bodies 194 and 196 are cemented to the tab plate 195 in the central portion only by cement locations 203 and 204 respectively.

Figure 46:
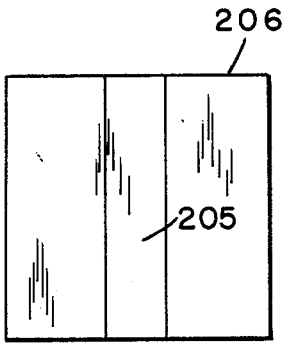
FIGS. 46, 47 and 48 show three variations of a roadway pattern which may be used in connection with the present invention.

FIG. 46 shows a variation of a roadway pattern 205 on a tile 206. The pattern is in the form of a straight roadway whose ends terminate on the centers of opposite edges of the tile.

Figure 47:
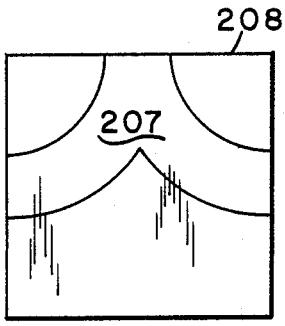

FIG. 47 shows a roadway 207 on a tile 208. The roadway 207 constitutes two arcs which merge together and have three terminals, each terminal being in the center of one of three edges of the tile 208.

Figure 48:
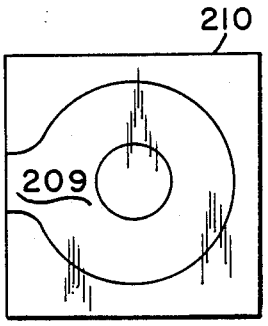

FIG. 48 shows a roadway 209 formed on the surface of the tile 210, the roadway being in the form of a circle or cul-de-sac having one entry from the center of one side of the tile 210.

It can be seen, then, that the toy roadway tile in every case consists of a main body in sheet form having a plurality of straight side edges of equal length and a plurality of land areas on one surface of the main body. The land areas serve to define a pattern of roadways, including a roadway that terminates in the center of one side edge with the center line of the roadway perpendicular to the said side edge. The other surface of the tile is also provided with land areas defining a pattern of roadways, but the pattern is different from the pattern of land areas on the first surface. Generally speaking, the configuration of the main body and the land areas is square. Generally speaking, a first roadway pattern on a first side of the tile differs from the second roadway pattern on the other side of the tile, so that the first pattern of the tile matches the second pattern of another similar tile to provide a continuous pattern when the two tiles are placed together. In one version of the tile, the first pattern is in the shape of a cross and in a second version of the invention the pattern consists of non-contacting arcuate roadways, each joining the center of a side edge to the center of an adjacent side edge. The pattern could be a straight line of roadway joined the centers of both sides of the main body. It could also consist of two arcuate roadways that have ends that merge and terminate at the center of one side of the main body, the other end of each arcuate roadway terminating at the center of one of the sides adjacent the said one side of the main body.

In one situation, the roadway pattern is a circle joined by a straight roadway to the center of one side of the main body.

The operation and advantages of the invention will now be understood in view of the above description. To begin with, it is clear that the invention involves a toy which employes a mechanism for the temporary interconnection of its segments or tiles in such a way to provide a large number of potential configurations. In a preferred embodiment, an individual toy segment may be fitted to other square toy segments in eight orientations. Each of these orientations may appear distinct as determined by the symmetry on the individual toy segment. The toy segments or tiles employ friction between the parts of their respective mechanisms to provide sufficiently stable interconnection while at the same time allowing disassembly without a requirement for the use of significant force. The present toy roadway tiles represent roads that have interconnecting mechanism which will not break easily, which are not difficult for a young child to assemble or disassemble, and which do not contain sharp protuberances or corners. Furthermore, the roadway may be reconstructed without requiring either the use of separate pieces specifically for the purposes of fastening the toy segments together or having a framework which holds the toy segments in such a way that the perimeter of the toy is fixed and bounded. Furthermore, multiple types of tiles are not necessary for the construction of varied patterns or roadways.

The present invention alleviates the problems of the prior art by employing an interconnection mechanism which is integral to the toy or tile itself. This characteristic permits unbounded configurations without the possibility of the child losing ancillary or auxiliary toy parts. In addition, the mechanism permits the toy segments to be interconnected in such a way that either surface may be used, therefore, allowing for different (but mating) patterns to be placed on opposite surfaces of the tiles. The toy does not require any particular physical motor skills to assemble it, so that young children can use the toy. Furthermore, a guiding mechanism is used to assist in the joining process.

It is obvious that minor changes may be made in the form and construction of the invention without departing from the material spirit thereof It is not, however, desired to confine the invention to the exact form herein shown and described, but it is desired to include all such as properly come within the scope claimed.

The invention having been thus described, what is claimed as new and desired to secure by Letters Patent is:

I claim:

1. A two-sided reversible toy roadway tile, comprising:

(a) a first main body having a top surface, a bottom surface and at least three straight edges of equal length, and wherein said top surface forms one side of the roadway tile, (b) a second main body having a top surface, a bottom surface and at least three straight edges of equal length, and wherein said top surface forms the reverse side of the roadway tile, (c) roadways defining a pattern on said top surface of the first main body and on said top surface of the second main body, and wherein the roadways of said first main body are of a different pattern than the roadways of said second main body, (d) configurations defining land areas on said top surface of the first main body and on said top surface of the second main body, and wherein the land areas of said first main body are of a different configuration than the land areas of the second main body, (e) a tab plate which is interspaced between the bottom surface of said first main body and the bottom surface of said second main body, and wherein each straight edge of said first main body is aligned with a congruent straight edge of said second main body to form a roadway tile, said tab plate having a projection which extends beyond each of said sets of aligned edges to provide means for engaging a similar roadway tile, and wherein said projection is inserted between a main body and corresponding tab plate of said similar roadway tile, so that when the two roadway tiles are properly engaged, an edge of either the first main body or of the second main body of said roadway tile abutts an edge of either the first main body or of the second main body of said similar roadway tile, and whereby the pattern of roadways on said roadway tile and said similar roadway tiles are contiguous, and (f) means for securing the bottom surface of said first main body and the bottom surface of said second main body to opposite sides of said tab plate, wherein the patterns of roadways on said joined roadway tiles may be varied by reversing the orientation of one of said sides of the roadway tile, or alternatively by changing the alignment of an edge of either said first main body or of said second main body in relation to an edge of said similar roadway tile.

2. A roadway tile as recited in claim 1, wherein said land areas are elevated above said roadways, wherein each main body is formed of sheet material, and wherein said roadway tile further comprises a pair of spacers for separate attachment between the bottom surface of each main body and the respective surface of the tab plate.

3. A roadway tile as recited in claim 1, wherein the pattern of roadways on the top surface of said first main body form a cross-like intersection in which the roadways diverging from said intersection terminate at a straight edge in the center thereof, and wherein the pattern of roadways on the top surface of said second main body consist of arcuate roadways having ends which terminate at a straight edge in the center thereof.

4. A toy roadway tile comprising:

(a) a main body having a top surface, a bottom surface and at least three straight edges of equal length, (b) roadways defining a pattern on said top surface, (c) configuration defining land areas on said top surface, and wherein said land areas are elevated above said roadways, and (d) a tab plate attached to the bottom surface of said main body and having projections which extend beyond each of said straight edges of the main body, to provide means for engaging similar roadway tiles, wherein said bottom surface of the main body is attached to the tab plate inwardly of the main body's edges, so that the projection of said tab plate is fully inserted between the tab plate and main body of a similar roadway tile so that a straight edge of said similar roadway tile abutts a straight edge of said roadway tile, and whereby the patterns of roadways on the abutting roadway tiles are contiguous, wherein said roadway tile further comprises a second main body which is attached to the other surface of said tab plate, said second main body having a top surface, a bottom surface and at least three straight edges of equal length, and wherein said top surface of the second main body includes a pattern of roadway and a configuration of land areas, which are of a different pattern and configuration than the roadways and land areas of said first main body, and wherein said land areas of the second main body are elevated above said roadways of the second main body.

* * * * *